United States Patent [19]

Getz et al.

[11] 4,007,836

[45] Feb. 15, 1977

[54] CORRUGATED-PAPERBOARD WRAPPER FOR PACKAGING ELECTRIC LAMPS, AND RESULTING LAMP PACKAGE

[75] Inventors: Edward J. Getz, Irvington; Thomas Barbieri, Peapack; Robert J. Stauffer, Cranford, all of N.J.

[73] Assignee: Westinghouse Electric Corporation, Pittsburgh, Pa.

[22] Filed: Apr. 10, 1974

[21] Appl. No.: 459,739

Related U.S. Application Data

[63] Continuation-in-part of Ser. No. 292,238, Sept. 25, 1972, abandoned.

[52] U.S. Cl. ..... 206/422; 229/39 B; 229/DIG. 15

[51] Int. Cl.[2] ..... B65D 85/42

[58] Field of Search ..... 229/DIG. 5, 39 B; 206/418–422

[56] References Cited

UNITED STATES PATENTS

| | | | |
|---|---|---|---|
| 1,620,174 | 3/1927 | Wagner | 229/DIG. 5 |
| 2,825,496 | 3/1958 | Miessler, Sr. | 206/422 |
| 3,069,008 | 12/1962 | Dugre | 229/39 B |

*Primary Examiner*—William Price
*Assistant Examiner*—Douglas B. Farrow
*Attorney, Agent, or Firm*—D. S. Buleza

[57] ABSTRACT

The ability of an open-ended corrugated-paperboard lamp wrapper to withstand compressive forces and retain an inserted frictionally-gripped lamp are both enhanced by orienting the corrugations so that they extend obliquely across the walls of the wrapper at an angle of from about 10° to 35° with respect to the transverse axis of the wrapper. The compressive strength of a single-lamp wrapper fabricated from single-face corrugated paperboard having corrugations offset by 20° is increased by 19% and lamp-retention is increased by 20% compared to a conventional wrapper having corrugations that extend parallel to the transverse axis.

16 Claims, 5 Drawing Figures

CORRUGATED-PAPERBOARD WRAPPER FOR PACKAGING ELECTRIC LAMPS, AND RESULTING LAMP PACKAGE

CROSS-REFERENCE TO RELATED APPLICATION

This application is a continuation-in-part of application Ser. No. 292,238 filed Sept. 25, 1972, now abandoned.

BACKGROUND OF THE INVENTION

1. Field of the Invention:

This invention relates to the packaging art and has particular reference to an improved wrapper for protectively sleeving electric lamp bulbs and to the lamp package which is thereby produced.

2. Description of the Prior Art:

Electric lamp bulbs of the incandescent type employed in the home are presently packaged for shipment by inserting them into open-ended tubular sleeves or wrappers of single-face corrugated paperboard and placing the resulting lamp packages or so-called lamp "packs" into a cardboard box. To facilitate the handling of the sealed boxes in the warehouse and during loading and unloading, a number of them are usually placed on a pallet and the pallets are then stacked one upon the other. As a result of such stacking, the individual lamp wrappers of the lamp packages within the shipping boxes are subjected to compressive stresses which frequently cause the wrapper walls to buckle and collapse — with the result that the glass bulbs are sometimes crushed and broken.

Such compressive stresses are also produced when the loaded shipping box is being sealed in the factory and the outer flaps of the box are pressed firmly against the inner flaps to glue or staple them together.

Lamp wrappers made from single-face corrugated paperboard are well known in the art and are dimensioned to enclose and snugly grip either a single lamp bulb or a pair of bulbs to provide a single-lamp package or a dual-lamp package, respectively. In the case of wrappers designed for a pair of bulbs, an integral partition wall is provided within the wrapper to prevent the packaged lamps from physically contacting one another. Regardless of the type of wrapper involved, standard practice in the art is to fabricate the wrappers in such a way that the corrugations extend perpendicular to the longitudinal axis of the wrapper and, hence, to the direction in which the lamps are inserted into the wrappers. Conventional open-ended lamp wrappers thus employ corrugations or flutes that are parallel to the transverse axis of the wrapper.

While wrappers of such construction are satifactory from the standpoint of preventing the packaged lamps from contacting one another and breaking during shipment, they frequently fail to protect the lamps under compressive stress conditions encountered when the shipping containers are being sealed in the lamp factory or when the palletized containers are stacked in the warehouse or are being shipped. This deficiency arises from the fact that while corrugated packaging material has excellent compressive strength in the direction along which the corrugations extend, it buckles when subjected to stresses in a direction perpendicular to the corrugations (in the same plane). The latter condition is frequently encountered during the handling and shipment of palletized loads of lamp packs and sometimes causes the packaged lamps inside the shipping container to be broken.

SUMMARY OF THE INVENTION

The present invention solves the foregoing and other problems associated with conventional open-ended lamp wrappers by fabricating them in such a way that the corrugations or flutes of the paperboard extend obliquely across the walls of the wrapper at a predetermined angle relative to the transverse axis of the wrapper. The resultant offsetting or "skewing" of the corrugations from their conventional orientation increases the resistance of the wrappers to compressive forces that would otherwise stress the walls in a direction which is perpendicular to the transverse axis and cause the wrapper to buckle and collapse. By properly controlling the angle at which the corrugations are offset, the ability of the open-ended wrapper to retain an inserted lamp bulb (or bulbs) is also improved.

The obliquely-oriented corrugations also insure that cutting and scoring of the paperboard always takes place across rather than along the corrugations. More positive scoring and neater folding and severing of the material are thus achieved - all of which enhance the appearance of the finished wrapper and the resulting lamp package.

BRIEF DESCRIPTION OF THE DRAWINGS

The invention will become more readily apparent from the description of the exemplary embodiments shown in the drawing, wherein.

DESCRIPTION OF THE PREFERRED EMBODIMENTS

Figure 1:
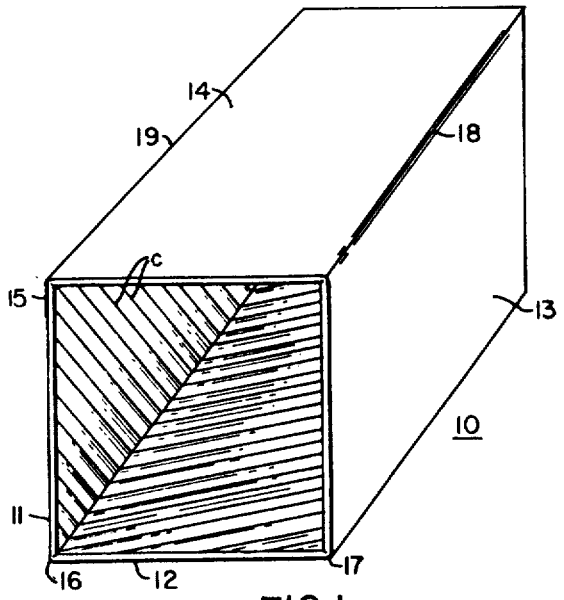
FIG. 1 is a perspective view of a single-lamp wrapper embodying the invention.

The embodiment shown in FIG. 1 consists of a single-lamp wrapper 10 that is of square cross-sectional configuration and open ended. The elongated wrapper 10 has four walls 11, 12, 13 and 14 that are hingedly connected to one another along score lines 16, 17, 18 and are held in tubular sleeve form by means of a flap 15 that extends along another hinge line 19 and is glued (or otherwise attached) to the edge of the adjacent wall 11. The wrapper 10 is made of single-face corrugated paperboard and the inner face of the wrapper is defined by the flutes or corrugations *c* of the paperboard, which corrugations extend obliquely across the perspective walls of the wrapper as shown.

Figure 2:
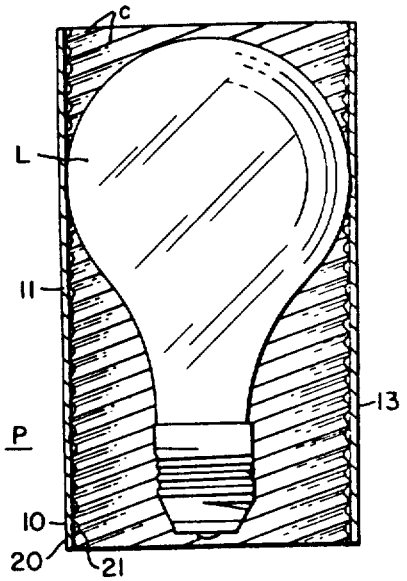
FIG. 2 is a longitudinal sectional view of the wrapper of FIG. 1 after it has been loaded with an electric light bulb to provide a single-lamp package.

As will be noted in FIG. 2, the single-face corrugated paperboard consists of a facing sheet 20 of smooth paper that is glued to a sheet of corrugated paper 21. The wrapper 10 is of such length that it totally encloses the electric lamp L (or other article) to form a package P in which the inserted lamp is frictionally gripped by the obliquely-extending corrugations *c* and thus retained within the wrapper.

Figure 3:
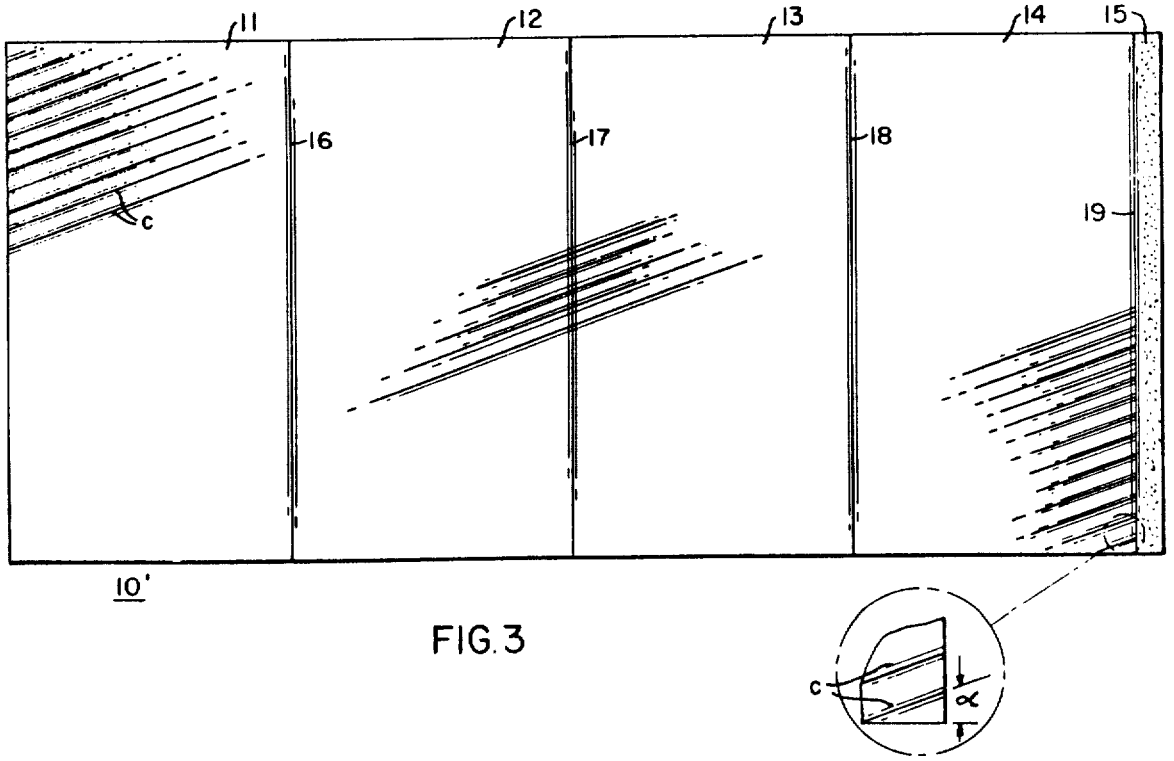
FIG. 3 is a plan view of the blank from which the wrapper shown in FIGS. 1 and 2 has been fabricated.

As shown in FIG. 3, the wrapper 10 is preferably formed from a blank 10' that comprises a single piece of corrugated paperboard that is divided by parallel-spaced score lines 16, 17 and 18 into the respective wall panels 11–14. The corrugated sheet of paper 21 is terminated along hinge line 19 inwardly from the edge of the facing sheet 20 to provide a connecting tab 15 that is coated with a suitable adhesive.

As illustrated in the enlarged portion of FIG. 3, the corrugations *c* extend at a predetermined angle relative to the longitudinal axis of the blank 10' and, hence, to a plane that is perpendicular to the longitudinal axis of the tubular wrapper 10 which is subsequently formed when the blank 10' is assembled and set up for loading. The corrugations are thus angularly offset from the transverse axis of the wrapper 10. The offset angle (angle $\alpha$ in FIG. 3) is critical and must be maintained within a certain range if both the compressive strength and the bulb-retention ability of the wrapper are to be improved. This is evident from the comparative test data set forth in Table I below.

TABLE I (Single-Lamp Open-Ended Wrapper)

| Offset Angle | | Test Weight | No. of Drops to Dislodge Lamp | |
|---|---|---|---|---|
| (Standard) | 0° | 6 lb. 15 oz. | 5 | |
| | 10° | 7 lb. 5 oz. (5% imp.) | 6 | (20% imp.) |
| | 15° | 7b. 7 oz. | — | |
| | 20° | 8 lb. 4 oz (19 % imp.) | 6 | " |
| | 25° | 8 lb. 8 oz. | — | |
| | 30° | 9 lb. 7 oz. | — | |
| | 35° | 10 lb. 4 oz (48% imp.) | 6 | " |
| | 40° | 10 lb. 3 oz. | — | |
| | 45° | 10 lb. 5 oz. | 3 | |
| | 50° | 12 lb. 8 oz. | — | |
| | 55° | 13 lb. 6 oz. | — | |
| | 60° | 16 lb. 3 oz. | — | |
| | 65° | 21 lb. 6 oz. | — | |
| | 70° | 19 lb. 10 oz. | — | |
| | 75° | 27 lb. 2 oz. | — | |
| | 80° | 25 lb. 9 oz. | — | |

The test data was obtained by manually fabricating a series of single-lamp open-ended wrappers from single-face corrugated paperboard having the same weight, thickness, grade, etc. and cutting the paperboard in such a manner that the corrugations were offset from the transverse axis of the wrapper by the various angles indicated in Table I. The compressive strength of each wrapper was tested by inserting a lamp bulb therein to form a lamp pack, positioning the lamp pack in an upright position, placing a known weight on top of it, and increasing the weight by known increments until the wrapper started to buckle and collapse.

The lamp-retention ability of the wrappers was determined by manually fabricating another group of open-ended wrappers from the same kind of paperboard that was again cut in a manner such that the corrugations were offset by a selected angle. A lamp bulb was then inserted into normally loaded position in the wrapper and the latter was fastened by clips to the holder of a test device that was dropped through a vertical distance of two inches and stopped by allowing it to strike the base plate of the device. The holder and attached lamp pack were then raised and dropped repeatedly until the lamp bulb was dislodged and fell out of the wrapper. The "number of drops" given in Table I represents an average obtained by drop-testing four separate lamp packs having four different wrappers with the same offset angle.

While the aforesaid wrappers were hand cut and fabricated, it will be understood that in practice they would be mass-produced using properly-corrugated paperboard.

As will be noted from the test data in Table I, a conventional or standard single-lamp wrapper of open-ended construction having horizontally disposed flutes (0° offset angle) withstood a weight of 6 pounds, 15 ounces before collapsing and required 5 drops to dislodge an inserted lamp bulb. In contrast, wrappers having corrugations offset by 10° withstood a weight of 7 pounds, 5 ounces (a 5% improvement) and required 6 drops to dislodge the inserted lamp (a 20% increase in lamp-retentivity).

The compressive strength increased as the offset angle increased and, at an angle of 65°, was over three times that of the standard wrapper. However, the lamp-retentivity of the wrappers continued to show the 20% improvement (6 drops) for offset angles up to 35° and then abruptly decreased by 50% (3 drops) as the offset angle was increased fron 35° to 45°. The retention tests were discontinued at this point since it was obvious that the ability of the wrappers to retain the inserted lamps would inherently become poorer as the corrugations approached vertical orientation (90° offset) and extended along rather than across the direction of lamp insertion and displacement.

The ability of the open-ended wrapper to retain an inserted lamp bulb is important from a merchandizing standpoint since it prevents the bulb from falling out of the wrapper and accidently breaking while the lamp package is being handled by a store clerk or a prospective customer. On the basis of the test data obtained with respect to both the compressive strength and lamp-retention ability of the wrappers set forth in Table I, it is apparent that the offset angle should be maintained within the range of from about 10° to 35°.

From the standpoint of mass-producing the single-face obliquely-corrugated paperboard from continuous webs of material on high-speed equipment used in the industry, a small offset angle is preferred since it would not only facilitate the manufacture of the fluting rolls of the machines but would also reduce the drag or tension on the fast-moving strip of paper and minimize the danger of tearing it while it is being fed through the fluting rolls. An offset angle in the range of from about 15° to 25° is thus preferred when all three factors are taken into consideration. An off-set angle of approximately 20° appears to be optimum since it provides a 19% improvement in compressive strength as well as a 20% improvement in lamp-retention and is small enough to avoid any difficulties in modifying and operating the fluting apparatus on the machines presently used in the paperboard industry.

Figure 4:
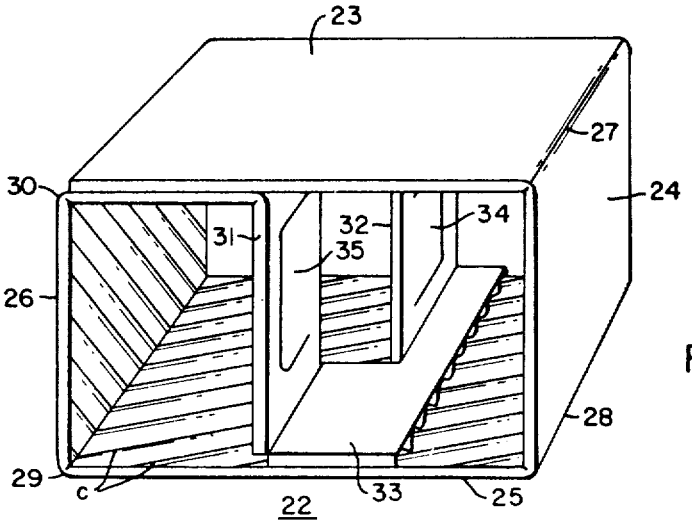
FIG. 4 is a perspective view of a dual-lamp wrapper embodiment.
Figure 5:
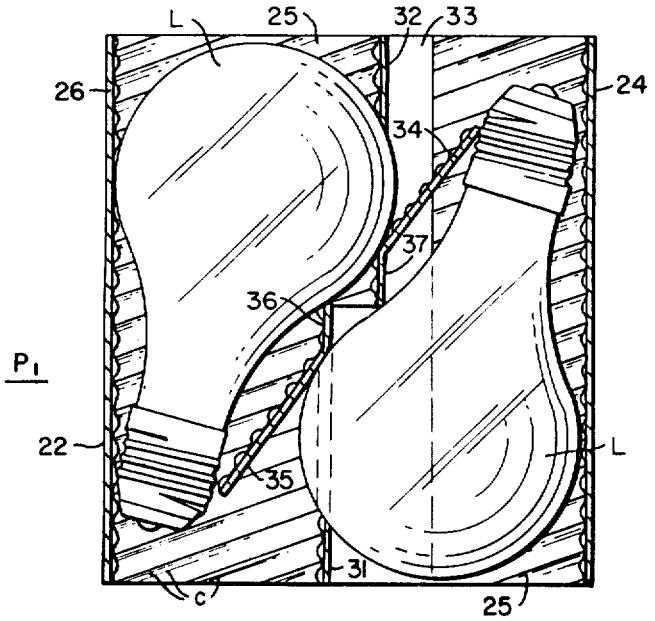
FIG. 5 is a cross-sectional view of the aforementioned dual-lamp wrapper after it has been loaded with a pair of lamp bulbs to provide a dual-lamp package.

The invention is not limited to single-lamp wrappers and packages but can be used with the same advantages in dual-lamp wrappers of the open-ended type shown in FIG. 4 to provide a dual-lamp package, such as that illustrated in FIG. 5. As illustrated, the wrapper 22 has four walls 23, 24, 25 and 26 that are hingedly connected along score lines 27, 28, 29 and 30, and encloses a pair of light bulbs L arranged in side-by-side base-to-bulb relationship. The walls comprise panels or parts of a continuous piece of single-face corrugated paperboard the end section of which is suitably cut and scored to provide a pair of laterally-offset partitions 31 and 32 and an anchoring tab 33 that is glued to the wall 25. The split partition walls 31 and 32 are approximately ½ the length of the wrapper 22 and are each provided with hinged locking flaps 34, 35. In accordance with the present invention, the inner surface of the open-ended duplex wrapper 22 is defined by a series of flutes or corrugations *c* that extend obliquely across the walls of the wrapper at a particular offset angle as described previously. A conventional dual-lamp wrapper of open-ended construction having corrugations that extend horizontally (that is, parallel relative to the transverse axis of the wrapper) and which has offset partitions devoid of locking flaps is disclosed in U.S. Pat. No. 2,825,496 issued Mar. 4, 1958 to P. W. Miessler, Sr.

As shown in FIG. 5, when the electric lamps L are inserted into the improved wrapper 22 the flaps 34 and 35 are pushed outwardly into the adjacent compartments and the inner edges of the respective partitions 31 and 32 constitute upstanding bridging panels 36 and 37 that extend completely across the interior of the wrapper 22 and maintain a protective air spacing between the packed lamps. Each of the lamps L are thus firmly locked in spaced and nested position within the open-ended sleeve 22. The resulting dual-lamp package $P_1$ is thus quite compact and, by virtue of the angularly-skewed corrugations *c*, it exhibits a greater resistance to buckling under compressive stress and an enhanced ability to retain the lamps inside the wrapper 22. Lamp retention of such dual-lamp wrappers was improved by approximately 75% (average) by using corrugations with a 15° offset.

As will be appreciated by those skilled in the art, the offsetting of the flutes or corrugations from their conventional alignment in accordance with this invention also provides more positive scoring and cleanly cut edges since scoring and severing of the paperboard will always be done across the flutes instead of parallel to the fluting (as frequently occurs with conventional corrugated paperboard).

We claim as our invention:

1. A wrapper for protectively packaging an electric lamp bulb or a similar fragile article, said wrapper consisting essentially of an elongated open-ended sleeve that has a plurality of connected walls and is composed of single-face corrugated paperboard the corrugations whereof constitute the inner surfaces of said sleeve and extend obliquely across the respective walls thereof at an angle of from about 10° to 35° relative to the transverse axis of the wrapper so that both the compressive strength and frictional article-retaining ability of the wrapper are enhanced.

2. The wrapper of claim 1 wherein said sleeve consists of a continuous piece of single-face corrugated paperboard that is cut, scored and folded to provide a series of wall panels one of which is hingedly connected to one end of said continuous piece of paperboard.

3. The wrapper of claim 2 wherein;

said piece of single-face corrugated paperboard is divided into four wall panels and the wrapper is thus of rectangular cross section, and said corrugations are disposed at an angle of from about 15° to 25° relative to the transverse axis of the wrapper.

4. The wrapper of claim 2 wherein said corrugations are disposed at an angle of approximately 20° relative to said transverse axis.

5. The wrapper of claim 2 wherein two of said wall panels are secured to partition means which divides the interior of the wrapper into a pair of article-receiving compartments.

6. The dual-article wrapper of claim 5 wherein said partition means comprises an end section of said piece of corrugated paperboard that is so cut and scored that it defines a partition wall panel and an anchoring tab that is secured to a wall of said sleeve.

7. The dual-article wrapper of claim 6 wherein;

said end section is so cut and scored that it defines a pair of laterally-offset partition walls each of which is approximately one half the length of the wrapper, and a medial portion of each of said partition walls is displaceable from the plane of the associated partition wall and defines a locking flap that is hinged to the inner edge segment of said associated partition wall.

8. The dual-article wrapper of claim 7 wherein the said inner edge segments of the respective partition walls constitute upstanding bridging panels that extend completely across the interior of the wrapper and thus maintain a protective spacing between a pair of articles that are inserted into the respective article-receiving compartments of the wrapper.

9. The dual-article wrapper of claim 8 wherein said corrugations are disposed at an angle of from about 15° to 25° relative to said transverse axis.

10. The dual-article wrapper of claim 8 wherein said locking flaps are so shaped and arranged that a pair of bulbous-shaped articles inserted into said sleeve are locked in spaced and nested position therein.

11. A package comprising the combination of;

a fragile elongated article of bulbous configuration, and a wrapper protectively enclosing said fragile article, said wrapper consisting essentially of an elongated open-ended sleeve that has a plurality of connected walls and is composed of single-face corrugated paperboard the corrugations whereof constitute the inner surfaces of the sleeve and extend obliquely across the respective walls thereof at an angle of from about 10° to 35° relative to the transverse axis of the wrapper so that both the compressive strength and frictional article-retaining ability of the wrapper are enhanced, the cross-sectional configuration and dimensions of said wrapper being so correlated relative to the cross-sectional configuration and dimensions of the fragile article that the obliquely-oriented corrugations on the inner surfaces of the wrapper are in engagement with and frictionally grip the article and thereby retain the latter within said wrapper.

12. The package of claim 11 wherein;

said fragile article comprises an electric lamp that has a glass bulb, and said wrapper has four walls and is rectangular in cross-section.

13. A package comprising the combination of;

a pair of elongated fragile articles that are of bulbous configuration, and a wrapper protectively enclosing said pair of fragile articles and holding them in side-by-side nested but non-contacting relationship, said wrapper consisting essentially of an elongated open-ended sleeve that has a plurality of connected walls and partition means which divides the interior of the sleeve into a pair of article-receiving compartments in which the fragile articles are located, said partition means being disposed between said articles and maintaining a spacing therebetween, said wrapper being composed of single-face corrugated paperboard the corrugations whereof constitute the inner wall surfaces of the wrapper and extend obliquely across the respective walls thereof at an angle of from about 10° to about 35° relative to the transverse axis of the wrapper so that both the compressive strength and frictional article-retaining ability of the wrapper are enhanced, the cross-sectional configuration and dimensions of each of the article-receiving compartments defined by the partitioned wrapper being so correlated relative to the cross-sectional configurations and dimensions of said pair of articles that the obliquely-oriented corrugations on the inner wall surfaces of the wrapper are in engagement with and frictionally grip the respective articles and thereby retain them within said wrapper.

14. The dual-article package of claim 13 wherein;

said pair of fragile articles comprise a pair of electric lamps that have glass bulbs, said wrapper has four walls, and said partition means is secured to oppositely disposed walls of the wrapper.

15. The dual-lamp package of claim 14 wherein said partition means comprises a panel of single-face corrugated paperboard that is divided into a pair of laterally-offset partition walls each of which extends along approximately one half the length of the wrapper.

16. The dual-lamp package of claim 14 wherein;

said partition means comprises a panel that has two displaceable segments which are spaced from one another and constitute a pair of hinged locking flaps, and said locking flaps are displaced by the bulb portions of the repective electric lamps and said bulb portions extend into the associated openings in the partition panel created by said displaced locking flaps.

* * * * *